US010906786B2

(12) United States Patent
Benton et al.

(10) Patent No.: US 10,906,786 B2
(45) Date of Patent: Feb. 2, 2021

(54) ELECTRONICALLY CONTROLLED HYDRAULIC SWING SYSTEM

(71) Applicant: Manitowoc Crane Companies, LLC, Manitowoc, WI (US)

(72) Inventors: John F. Benton, Smithsburg, MD (US); Mark A. Harbold, Mercersburg, PA (US); Todd Snider, Fort Loudon, PA (US); David R. Peiffer, Waynesboro, PA (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 108 days.

(21) Appl. No.: 15/881,450

(22) Filed: Jan. 26, 2018

(65) Prior Publication Data

US 2018/0148304 A1 May 31, 2018

Related U.S. Application Data

(63) Continuation of application No. 15/122,067, filed as application No. PCT/US2015/018469 on Mar. 3, 2015, now Pat. No. 9,878,886.

(Continued)

(51) Int. Cl.
*B66C 23/86* (2006.01)
*F15B 1/26* (2006.01)

(Continued)

(52) U.S. Cl.
CPC ..... *B66C 23/86* (2013.01); *B66C 23/36* (2013.01); *E02F 9/123* (2013.01); *E02F 9/2296* (2013.01);

(Continued)

(58) Field of Classification Search
CPC .. F15B 2211/31576; F15B 1/26; F15B 11/08; F15B 13/0401; B66C 23/84; B66C 23/86
See application file for complete search history.

(56) References Cited

U.S. PATENT DOCUMENTS 4,382,360 A 5/1983 Dummer
5,063,742 A * 11/1991 Yoshimatsu ..... E02F 9/123 60/466

(Continued)

FOREIGN PATENT DOCUMENTS

CN 85103931 A 10/1986
CN 1289392 A 3/2001

(Continued)

OTHER PUBLICATIONS

International Search Report and Written Opinion issued in connection with PCT/US2015/018469 dated May 26, 2015.

(Continued)

*Primary Examiner* — Michael R Mansen
*Assistant Examiner* — Juan J Campos, Jr.
(74) *Attorney, Agent, or Firm* — Klintworth & Rozenblat IP LLP

(57) ABSTRACT

A hydraulic circuit for use on a construction machine includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is (Continued)

connected to the first outlet port of the third valve, which operates the hydraulic motor in a second direction.

19 Claims, 7 Drawing Sheets

Related U.S. Application Data

(60) Provisional application No. 61/947,421, filed on Mar. 4, 2014.

(51) Int. Cl.

| | |
|---|---|
| ***F15B 11/08*** | (2006.01) |
| ***F15B 13/04*** | (2006.01) |
| ***E02F 9/12*** | (2006.01) |
| ***E02F 9/22*** | (2006.01) |
| ***B66C 23/36*** | (2006.01) |

(52) U.S. Cl.

CPC ..... *F15B 1/26* (2013.01); *F15B 11/08* (2013.01); *F15B 13/0401* (2013.01); *F15B 2211/20546* (2013.01); *F15B 2211/255* (2013.01); *F15B 2211/3057* (2013.01); *F15B 2211/7058* (2013.01)

(56) References Cited

U.S. PATENT DOCUMENTS

| | | | | |
|---|---|---|---|---|
| 5,159,813 | A | 11/1992 | Yoshimatsu et al. | |
| 5,499,503 | A | 3/1996 | Stoychoff | |
| 5,636,516 | A | 6/1997 | Kon | |
| 5,778,932 | A | 7/1998 | Alexander | |
| 6,938,414 | B1 | 9/2005 | Bruun | |
| 7,739,943 | B2 | 6/2010 | Wong et al. | |
| 7,765,915 | B2 | 8/2010 | Davison et al. | |
| 8,176,734 | B2 | 5/2012 | Throckmorton | |
| 2009/0308067 | A1 | 12/2009 | Meier et al. | |
| 2014/0007565 | A1* | 1/2014 | Yamashita | E02F 9/128 60/431 |
| 2014/0013752 | A1* | 1/2014 | Komiyama | E02F 9/123 60/706 |
| 2014/0013753 | A1* | 1/2014 | Ueda | E02F 9/123 60/706 |

FOREIGN PATENT DOCUMENTS

| | | | |
|---|---|---|---|
| CN | 101863424 | A | 10/2010 |
| CN | 102155447 | A | 8/2011 |
| CN | 202193573 | U | 4/2012 |
| CN | 103010980 | A | 4/2013 |
| DE | 102006040459 | A1 | 3/2007 |
| EP | 0454923 | A1 | 11/1991 |
| EP | 1609636 | A1 | 12/2005 |
| EP | 2241529 | A1 | 10/2010 |
| GB | 2267328 | A | 12/1993 |
| GB | 2285850 | A | 7/1995 |
| JP | S5740106 | A | 3/1982 |
| JP | S60043692 | U1 | 3/1985 |
| JP | S6275108 | A | 4/1987 |
| JP | H01108401 | A | 4/1989 |
| JP | H02291392 | A | 12/1990 |
| JP | H07125036 | A | 5/1995 |
| JP | H07112914 | B2 | 12/1995 |
| JP | 2008545934 | A | 12/2008 |

OTHER PUBLICATIONS

International Preliminary Report on Patentability issued in connection with PCT/US2015/018469 dated Sep. 15, 2016.

* cited by examiner

ELECTRONICALLY CONTROLLED HYDRAULIC SWING SYSTEM

PRIORITY CLAIM

The present application is a continuation of U.S. patent application Ser. No. 15/122,067 filed on Aug. 26, 2016, which is a national phase application of International Application No. PCT/US2015/018469 filed on Mar. 3, 2015, which in turn claims priority to and the benefit of U.S. Provisional Patent Application Ser. No. 61/947,421 filed Mar. 4, 2014 and titled Electronically Controlled Hydraulic Swing System, the disclosures of which are incorporated in their entireties by this reference.

BACKGROUND

The present application relates to construction equipment, such as cranes. In particular, the present application relates to a construction machines that include an electronically controlled hydraulic circuit. In the instance of cranes, the hydraulic circuit operates to control the rotation or swing of an upper portion of the crane relative to a lower portion.

Previous cranes typically used a hydraulic circuit that employed what are known as spool valves to control the hydraulic motor that turned the upper portion of the crane relative to the lower portion of the crane. These spool valve based systems posed several challenges, however.

First, an off-the-shelf spool valve typically was not available for a given application. Therefore a specialized, highly customized, and application-specific spool valve typically was required. Understandably, these specialized spool valves typically were quite costly. Further, by nature of the spool and manufacturing tolerances, the valves often had imprecise flow rates and suffered from leakage across the valve at what were ostensibly no flow conditions.

In addition, the manufacturing imperfections increased the possibility of uneven movements when changing from rotating in one direction to the other. Such uneven movements typically were the outward manifestation of pressure spikes within the hydraulic circuit, pressure spikes that pose an elevated risk of damaging the hydraulic circuit.

For example, one effort to resolve this issue involved using open center spool valves, which led to improved and softer counter-slewing (i.e., changing the direction of rotation without coming to a complete stop). The open center spool valve, however, led to inconsistent starts.

Alternatively, closed center spool valves resulted in smoother and more consistent initiation of a rotation. Unfortunately, the trade-off was less satisfactory performance during counter-slewing, including abrupt shifts.

Regardless of the specific type of spool valve, collectively these issues lead to crane-specific hydraulic circuits that require individual calibration of the control systems. These issues typically prevented the ability to achieve perfectly symmetric flow in each portion of the hydraulic circuit that controls the each direction of rotation of the hydraulic motor. In other words, the hydraulic circuit might behave differently when slewing or rotating clockwise than it would when slewing or rotating counter-clockwise. While some of this might result might be accounted for in the (often crane-specific) calibration of the hydraulic circuit, it nonetheless poses a challenge for the crane operator who must retain awareness about the crane-specific issues with its performance.

It is therefore desirable to provide a crane with a hydraulic circuit to control the swing or rotation of an upper portion relative to a lower portion of the crane. The hydraulic circuit should provide for easier calibration, consistent operation amongst different cranes, smoother and more consistent starts to rotation and counter-rotation/counter-slewing.

BRIEF SUMMARY

A hydraulic circuit for use on a construction machine, such as a crane, includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. The hydraulic circuit includes a shuttle valve downstream of and connected to a first outlet port of the second valve and a first outlet port of the third valve. The shuttle valve detects or senses the second pressure and the third pressure and permits hydraulic fluid associated with the higher of the second pressure and the third pressure to flow to the first valve. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. The hydraulic circuit includes a shuttle valve downstream of and connected to a first outlet port of the second valve and a first outlet port of the third valve. The shuttle valve detects or senses the second pressure and the third pressure and permits hydraulic fluid associated with the higher of the second pressure and the third pressure to flow to the first valve. The hydraulic circuit further comprises a fourth valve positioned between the shuttle valve and the first valve. The fourth valve includes a first position in which the hydraulic fluid is prevented from flowing from the shuttle valve to the first valve and a second position in which the hydraulic fluid is permitted to flow from the shuttle valve to the first valve. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. The hydraulic circuit further comprises a pressure accumulation device positioned downstream of the first outlet port of the second valve and the first outlet port of the third valve and before the first valve. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. The hydraulic circuit further comprises a flow restriction positioned downstream of the first outlet port of the second valve and the first outlet port of the third valve and before the first valve. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. The hydraulic circuit further comprises at least one of a flow restriction formed integrally within the second outlet port of at least one of the second valve and the third valve and a flow restriction positioned downstream of at least one of the second outlet port of the second valve and the second outlet port of the third valve and before the tank. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. At least one tank provides a source of hydraulic fluid to and receiving hydraulic fluid from the hydraulic circuit. At least one variable displacement hydraulic pump is connected to the at least one tank and provides a flow of hydraulic fluid to the hydraulic circuit at an initial pressure. The hydraulic circuit further includes a first pressure sensor connected to the first outlet port of the second valve and is configured to generate a first signal reflective of the pressure at the first outlet port of the second valve. At least a second pressure sensor is connected to the first outlet of the third valve and is configured to generate a second signal reflective of the pressure at the first outlet port of the third valve. A controller is configured to receive the first signal and the second signal and calculates a differential signal reflective of a differential pressure between the pressure at the first outlet port of the second valve and the pressure at the first outlet port of the third valve. The controller converts the differential signal into a pump signal that the controller sends to the variable displacement hydraulic pump to adjust the hydraulic flow in response to the pump signal.

Another embodiment of the hydraulic circuit includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor in a first direction. The hydraulic motor also is connected to the first outlet port of the third valve, which operates the hydraulic motor in a second direction. A solenoid actuated enablement valve includes a first position in which the hydraulic fluid is prevented from flowing through the hydraulic circuit and a second position in which the hydraulic fluid is permitted to flow through the hydraulic circuit. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

Another embodiment of the hydraulic circuit includes at least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure. The hydraulic circuit includes a first valve and at least a second valve. The first and second valve each includes at least one inlet port connected to the hydraulic pump. The first outlet port of each of the first and second valves are configured to reduce an initial pressure to a first pressure and/or a second pressure downstream of the first valve and the second valve, respectively. The first valve and the second valve also include at least a second outlet port connected to a reservoir tank. A hydraulic motor is connected to the first outlet port of the first valve, which operates the hydraulic motor in a first direction. The hydraulic motor also is connected to the first outlet port of the second valve, which operates the hydraulic motor in a second direction.

An embodiment of a lift crane includes a lower portion, an upper portion that includes a boom mounted thereto, and a swing bearing that rotatably couples the lower portion to the upper portion. A hydraulic circuit for use on the crane includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. A hydraulic motor is connected to the first outlet port of the second valve, which operates the hydraulic motor to rotate the upper portion relative to the lower portion in a first direction. The hydraulic motor also is connected to the first outlet port of the third valve, which operates the hydraulic motor to rotate the upper portion relative to the lower portion in a second direction. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

An embodiment of a control system for a hydraulic motor in a construction machine includes at least one power source that includes an output sensor to detect an output of the power source and to generate an output signal reflective of the output. A hydraulic circuit for use on a construction machine, such as a crane, includes a first valve, a second valve, and at least a third valve. The second and third valve each includes at least one inlet port connected to a first outlet port of the first valve. The first outlet port of each of the second and third valves are configured to reduce a first pressure to a second pressure and/or a third pressure downstream of the second valve and the third valve, respectively. The second valve and the third valve also include at least a second outlet port connected to a reservoir tank. At least one of the second valve and the third valve is an electrically actuated valve configured to receive an actuation signal$_t$ that adjusts the valve in in proportion to a magnitude of an actuation signal$_t$, thereby providing a variable decrease in the at least one of said second pressure and said third pressure. A hydraulic motor is connected to the first outlet port of the second valve, which operates the hydraulic motor in a first direction. The hydraulic motor also is connected to the first outlet port of the third valve, which operates the hydraulic motor in a second direction. At least one tank provides a source of hydraulic fluid to and receiving hydraulic fluid from the hydraulic circuit. At least one hydraulic pump is connected to the at least one tank and provides a flow of hydraulic fluid to the hydraulic circuit at an initial pressure.

The control system also includes an input device that generates an input signal reflective of a position of the input device as an operator manipulates the input device. A memory storage device is configured to store an operating program that calculates the actuation signal$_t$ as a function of at least one of the input signal; the output signal; an actuation signal$_{t-1}$; a first database that correlates said input signal relative to time; a second database that correlates the actuation signal$_{t-1}$ to the input signal; a first gain that allows an operator to selectively increase and decrease a magnitude of the actuation signal$_t$ relative to the input signal; and a second gain that selectively increases and decreases the magnitude of the actuation signal$_t$ relative to the output signal.

The control system also includes a controller configured to receive at least one of the input signal from the input device and the output signal from the power source. The controller additionally runs the operating program and transmits the actuation signal$_t$ to at least one of the second valve and the third valve.

These and other advantages, as well as the invention itself, will become more easily understood in view of the attached drawings and apparent in the details of construction and operation as more fully described and claimed below. Moreover, it should be appreciated that several aspects of the invention can be used with other types of cranes, machines or equipment.

DETAILED DESCRIPTION

The present invention will now be further described. In the following passages, different aspects of the embodiments of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

In addition, the figures illustrate various hydraulic circuits in the standard representational format. The physical embodiment might appear much different than the representational format, but the relevant positions and connections in the physical embodiment will reflect those in the figures. For example, it may be said that a pressure sensor is connected to an outlet. One of skill in the art will understand that in the physical embodiment the connection is a hydraulic connection. The sensor and the outlet may be, but not necessarily, in an abutted arrangement.

Embodiments of the present invention find application in all types of construction machines. For example, embodiments of the present invention find advantageous use in lift cranes of all types, including mobile cranes, such as those propelled on wheels, crawlers, tracks, rings, etc.; and tower cranes, including platform cranes, mobile tower cranes, self-erecting tower cranes, cranes that that have a fixed base (e.g., a concrete base or foundation), etc. That said, the following description describes an electronically controlled hydraulic circuit suitable for controlling the swing of a crane as it to the crawler crane 10 of FIG. 1.

Figure 1:
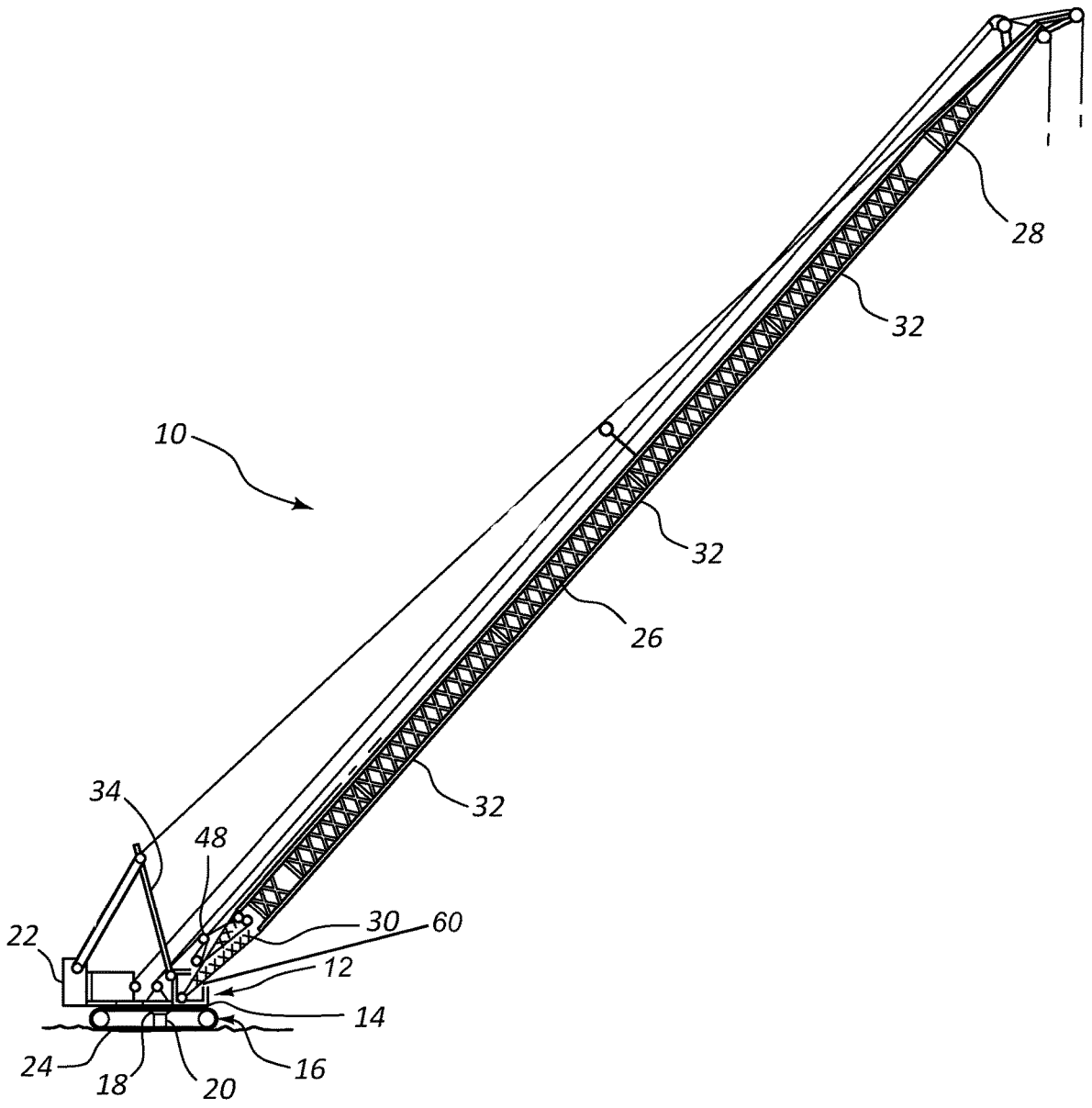
FIG. 1 is a right side elevation view of a mobile lift crane that includes an embodiment of a hydraulic circuit.

The crawler crane 10 includes an upper portion 12 having a rotating bed 14 that is rotatably connected to a lower portion 16 by a swing bearing 18. The lower portion 16 includes a car body 20, typically counterweights 22, and ground engaging members 24. Illustrated in FIG. 1 are crawlers, although the term ground engaging members encompasses things such as tires, for example. In addition, while only one ground engaging member 24 is visible, an identical ground engaging member 24 exists on the other side of crane 10. Further, the disclosure is not limited to only two ground engaging members 24. Rather, crane 10 may employ a plurality of ground engaging members, such as 3, 4, or more.

The rotating bed 14 includes a boom 26 pivotally connected to the rotating bed 14. The boom 26 comprises a boom top 28 and a tapered boom butt 30. The boom 26 may also include one or more boom inserts 32 connected between the boom top 28 and the boom butt 30 to increase the overall length of the boom 26. While FIG. 1 illustrates a lattice style boom 26, other known types of booms, such as round, oval, and/or telescoping type booms fall within the scope of the disclosure. An optional mast 34 is pivotally connected to the rotating bed 14.

The rotating body 14 or the upper works 12 further includes a power source 24, such as a diesel engine, although other sources of power such as batteries, electric motors, and the like may be used in addition to or as an alternative to an internal combustion engine. The power plant supplies power for the various mechanical and hydraulic operations of the crane 10, including movement of the ground engaging members 24, rotation of the upper portion 12 relative to the lower portion 16, rotation of the load hoist line drums, and rotation of the boom hoist drum. Operation of the various functions of the crane 10 typically is controlled from the operator's cab 60, although remote operating positions may be employed.

Figure 2:
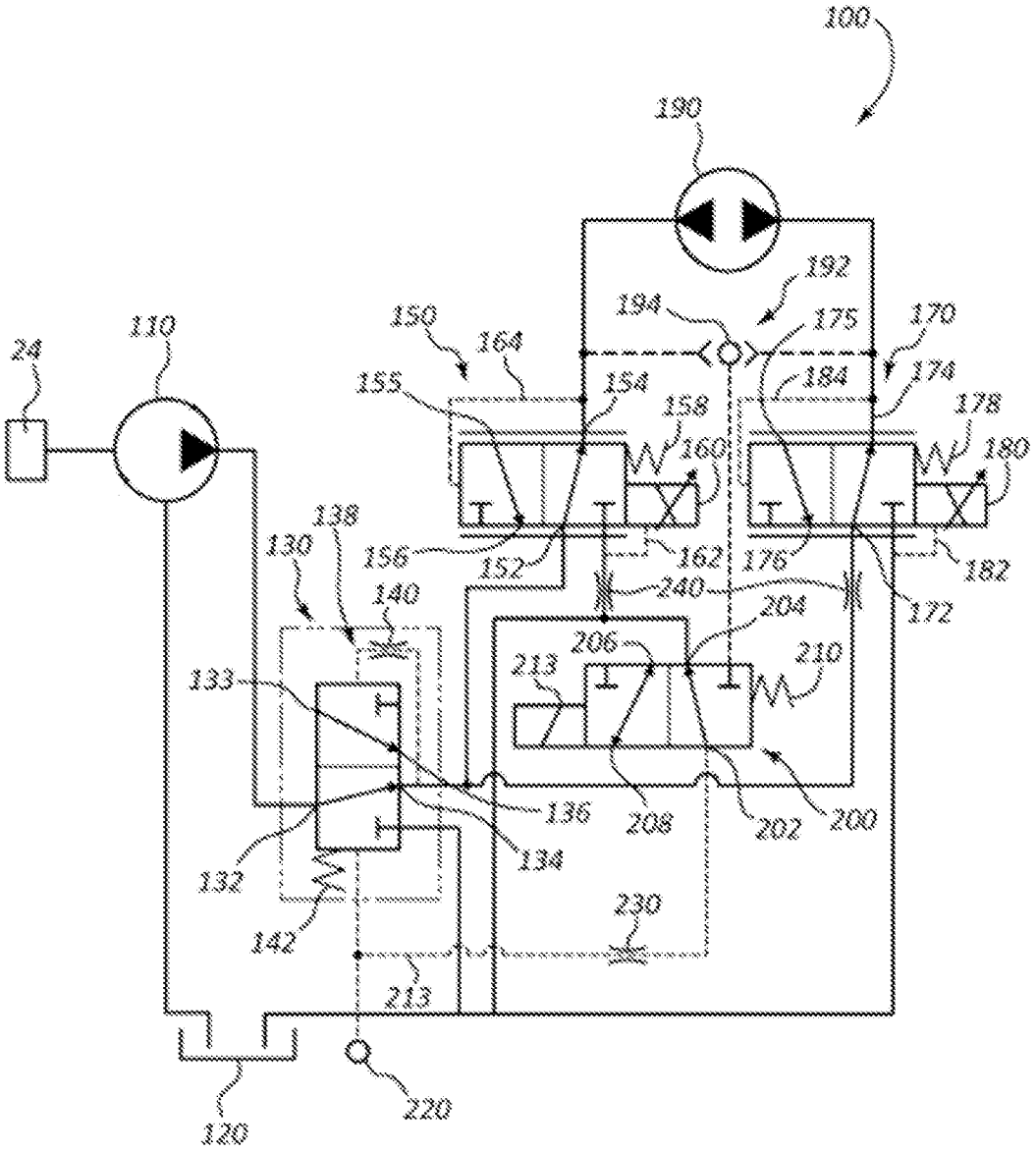
FIG. 2 is schematic view of a hydraulic circuit.
Figure 3:
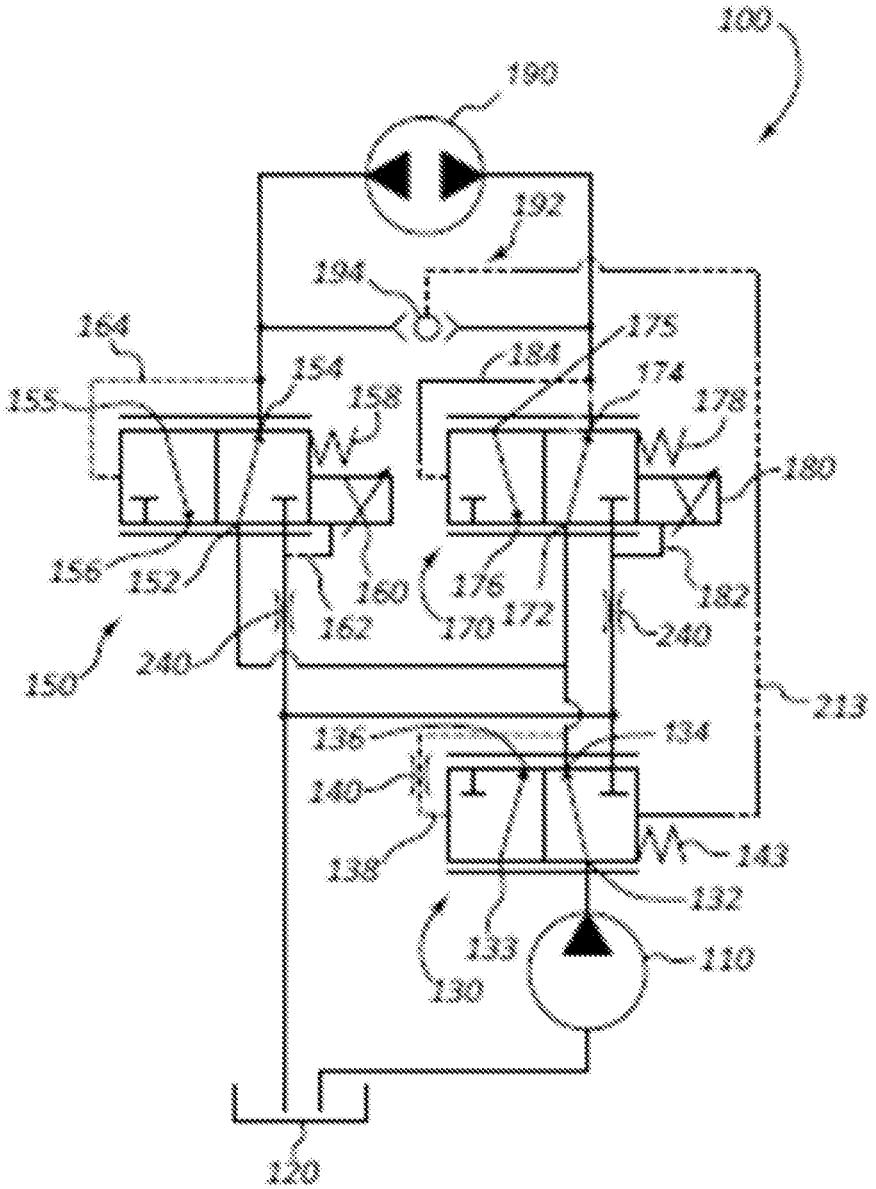
FIG. 3 is another embodiment of the hydraulic circuit in FIG. 2 with fewer of the optional features.

Embodiments of the invention include a hydraulic circuit 100 configured to rotate the upper portion 12 relative to the lower portion 16. Referring to FIGS. 2 and 3, the hydraulic circuit 100 includes the power source 24 coupled to provide power to at least one hydraulic pump 110. The hydraulic pump 110 is connected to at least one tank 120 that provides the hydraulic circuit 100 with a hydraulic fluid and receives hydraulic fluid from the hydraulic circuit 100. The hydraulic pump 110 provides a flow of hydraulic fluid to the hydraulic circuit 100 at an initial pressure.

A first valve 130 is configured to maintain a first pressure in the hydraulic circuit 100 downstream of the first valve 130. As just one example, the first pressure might be 100 pounds per square inch to 200 pounds per square inch, although other ranges fall within the scope of the disclosure.

The first valve 130 includes at least one inlet port 132 that is connected to the hydraulic pump 110, and, optionally, a second inlet port 133 that also can connect to the hydraulic pump 110. It should be noted that the inlet port may 132 be directly or indirectly connected to the hydraulic pump 110. For example, one or more hydraulic circuits, such as circuits for controlling the hoist drum or boom angle, might be positioned upstream of the first valve 130.

In some embodiments, the first valve 130 typically is an unloader valve that operates to divert excess flow of hydraulic fluid to avoid exceeding any pressure and/or flow tolerances or limits of various elements downstream of the first valve 130.

The first valve 130 includes at least a first outlet port 134 and at least a second outlet port 136. The first valve 130 includes a spring 142 that applies a spring force to adjust the first valve 130 so that when the initial pressure is less than or equal to the first pressure the flow of hydraulic fluid exits the first outlet port 134 at a first pressure. When the initial pressure is greater than the first pressure the flow of hydraulic fluid exits the second outlet port 136. In other words, the second outlet port 136 is configured to return an excess of hydraulic fluid to the tank 120. Of course, in other embodiments the spring 142 may be oriented to provide a different default or standard operating position or condition (e.g., default to have hydraulic fluid flow to the tank 120 rather than initially downstream of the first outlet port 134 towards at least one of second valve 150 and third valve 170).

Stated differently, the first valve 130 operates to permit the flow of hydraulic fluid from the first outlet port 134 while substantially preventing the flow of hydraulic fluid from the second outlet port 136 in a first condition. When a second condition or circumstance is met, the first valve 130 operates to substantially prevent the flow of hydraulic fluid from the first outlet port 134 while permitting the flow of hydraulic fluid from the second outlet port 136. Of course, it is possible to have intermediate positions in which the first valve 130 permits a portion of the hydraulic fluid to flow from both the first outlet port 134 and the second outlet port 136. Further, one of skill in the art will understand that regardless of the position of the first valve 130, manufacturing tolerances may still permit a pressure drop and/or a small amount of hydraulic fluid to flow from the second outlet port 136 in the first condition and, likewise, a pressure drop and/or a small amount of hydraulic fluid to flow from the first outlet port 134 in the second condition.

The first valve 130 optionally includes a pilot valve 138 that senses the pressure downstream of the first outlet port 134. The pilot valve 138 operates in combination with the spring 142 that adjusts, i.e., controls the opening and closing of the first outlet port 134 and the second outlet port 136 in response to a pressure downstream of the first valve 130 and the spring force applied by the spring 142. In the illustrated embodiment, the pilot valve 138 operates in opposition to the spring 142, although in other embodiments the pilot valve 138 operates additively to the spring 142. Optionally, the pilot valve 138 includes a flow restriction 140.

The hydraulic circuit 100 includes at least two valves that, in some embodiments, are a proportional pressure relieving-reducing type of valve. For example and as illustrated in FIG. 2, the hydraulic circuit 100 includes a second valve 150 and at least a third valve 170. Optionally, the second valve 150 and the third valve 170 are in parallel relationship to the first valve 130. In some embodiments, the second valve 150 and the third valve 170 are identical with each other.

The second valve 150 includes at least one inlet port 152 connected to the first outlet port 134. A first outlet port 154 is configured to reduce the first pressure downstream of the first valve 130 to a second pressure downstream of the first outlet port 154. In other words, the second pressure downstream of the first outlet port 154 is lower than the first pressure upstream of the first inlet port 152. Thus, it will be understood that the first outlet port 154 achieves the pressure reducing function of the reducing-relieving valve.

The first outlet port 154 permits the flow of hydraulic fluid to a downstream element 190. In the illustrated embodiment, the downstream element 190 is a motor, such as a hydraulic motor, a fixed displacement hydraulic motor, a variable displacement hydraulic motor, a single direction motor, a bi-directional hydraulic motor, and other similar types of motors. Of course, the downstream element 190 includes other known types of hydraulic circuits, controls, and elements. In the illustrated embodiment the downstream element 190 is a bi-directional hydraulic motor and, optionally, a variable displacement hydraulic motor. Thus, the hydraulic fluid that flows from the first outlet port 154 of the second valve 150 operates to rotate the hydraulic motor and, more specifically, the output shaft (not illustrated) of the hydraulic motor 190 in a first direction. The hydraulic motor 190 is mechanically coupled to the swing bearing 18, typically through a gear box (not illustrated) that interacts with the swing bearing 18, to rotate the upper portion 12 relative to the lower portion 16. Of course, the motor 190 may be coupled to the swing bearing 18 in any known or equivalent manner.

Referring back to the second valve 150, it also includes at least a second inlet port 155 connected to the motor 190 in certain valve positions and at least a second outlet port 156 connected to the tank 120. (Additional inlet and outlet ports beyond the first and second inlet ports 152, 155 and the first and second outlet ports 154, 156 fall within the scope of the disclosure.) The second outlet port 156 achieves the relieving function of the reducing-relieving valve because it is configured to return excess hydraulic fluid from the motor 190 to the tank 120. Like the first valve 130, the relieving function of the second valve 150 protects downstream elements from excessive flow and/or pressure.

The second valve 150 optionally includes a spring 158 that applies a spring force to adjust the second valve 150 to achieve a desired minimum operating condition, such as a selected pressure reduction between the first pressure upstream of the valve 150 (i.e., downstream of the first valve 130) and the second pressure downstream of the first outlet port 154.

In some embodiments, the second valve 150 is an electrically activated or electrically actuated valve. For example, the second valve 150 optionally includes a solenoid 160, thus making the second valve 150 a solenoid actuated valve. The force that the solenoid 160 exerts on the second valve 150 works in conjunction with the spring force of the spring 158 in the illustrated embodiment. In different embodiments of the second valve 150, however, the force that the solenoid 160 applies opposes the spring force depending on the desired default condition/performance of the second valve 150. In addition, the solenoid 160 optionally is variable or adjustable solenoid that allows for selective control of the solenoid 160.

The solenoid 160 is configured to receive an actuation signal$_t$ 780 from a controller 750 to adjust the position of the solenoid 160 and, consequently, the position of the first outlet port 154 and the second outlet port 156 so as to alter the condition or performance of the second valve 150. In some embodiments, the actuation signal$_t$ 780 typically is a current, the magnitude of which is proportional to the desired force and/or movement that the solenoid 160 applies to the second valve 150. Of course, other embodiments might include an actuation signal$_t$ 780 that is another analog signal or a digital signal for a digital actuator. Thus, as will be discussed below further, the pressure drop across and/or the rate at which the hydraulic fluid flows out of the first outlet port 154 and the second outlet port 156 may be controlled by applying an actuation signal$_t$ 780 that is a function of, and typically proportional to, an input signal 722 that an operator provides to an input device 720.

A benefit of this proportional control of the second valve 150 is that pressure drop across the valve (i.e., the second and third pressure, as it relates to third valve 170) and associated flow to the motor 190 is in turn proportional to the actuation signal$_t$ 780 and thus more accurately controlled, leading, in turn to a more precise and proportional control of the output/torque of the motor 190 and, consequently, the speed at which the upper portion 12 rotates relative to the lower portion 16.

It will thus be understood that the second valve 150 operates to permit the flow of hydraulic fluid from the first outlet port 154 at a pressure drop that is proportional to an actuation signal provided to the solenoid 160 while limiting and, in some instances, preventing the flow of hydraulic fluid from the second outlet port 156. As an operator wishes to change the performance or output of the downstream element 190 to which the first outlet port 154 is connected, the second valve 150 operates under the influence of the spring 158 and/or the solenoid 160 to increase or decrease the pressure of the hydraulic fluid from the first outlet port 154 from a minimum operating pressure to full pressure (i.e., 100% of available pressure). Concurrently, the second valve 150 operates to increase or decrease the pressure of the hydraulic fluid from the second outlet port 156 from minimum relief pressure to full pressure (i.e., 100% of available pressure). Of course, it is possible to have intermediate positions in which the second valve 150 permits hydraulic fluid to flow at a portion of the available hydraulic pressure from both the first outlet port 154 and the second outlet port 156. Further, one of skill in the art will understand that regardless of the position of the second valve 150, manufacturing tolerances may still permit a pressure drop and/or a small amount of hydraulic fluid to from the second outlet port 156 in the first condition (100% flow from first outlet port 154) and, likewise, a pressure drop and/or a small amount of hydraulic fluid to from the first outlet port 154 in the second condition (0% flow from the first outlet port 154).

The second valve 150 optionally includes a pilot valve 162, or first pilot valve, that senses the pressure upstream of the first inlet port 152 and provides that pressure to the spring 158 and/or the solenoid 160. The pilot valve 162 operates in combination with the spring 158 and/or the solenoid 160 to adjust, i.e., control the opening and closing of the first outlet port 154 and the second outlet port 156 in response to a pressure upstream of the second valve 150. In the illustrated embodiment, the pilot valve 162 operates additively with the spring 158 and/or the solenoid 160, although in other embodiments the pilot valve 162 operates in opposition to the spring 158 and/or the solenoid 160.

Similarly, the second valve 150 optionally includes a pilot valve 164, or second pilot valve, in addition to or as an alternate to the pilot valve 162. The pilot valve 164 senses the pressure downstream of the first outlet port 154 and provides that pressure to the second valve 150 in opposition to the spring 158 and/or the solenoid 160. The pilot valve 164 operates in combination with the spring 158 and/or the solenoid 160 to adjust, i.e., control the opening and closing of the first outlet port 154 and the second outlet port 156 in response to a pressure downstream of the first outlet port 154. In the illustrated embodiment, the pilot valve 164 operates in opposition to the spring 158 and/or the solenoid 160, although in other embodiments the pilot valve 164 operates additively with the spring 158 and/or the solenoid 160.

The third valve 170 includes at least one inlet port 172 connected the first outlet port 134. As noted above, the inlet port 172 is in a parallel connection with the first inlet port 154 of the second valve 150 and the first outlet port 134 of the first valve 130. A first outlet port 174 is configured to reduce the first pressure downstream of the first valve 130 to a third pressure downstream of the first outlet port 174. In other words, the third pressure downstream of the first outlet port 174 is lower than the first pressure upstream of the first inlet port 172. Thus, it will be understood that the first outlet port 174 achieves the pressure reducing function of the reducing-relieving valve. The second pressure downstream of the first outlet port 154 of the second valve 150 may be less than, equal to, or greater than the third pressure downstream of the first outlet port 174 of the third valve 170.

As with the second valve 150, the first outlet port 174 of the third valve 170 permits the flow of hydraulic fluid to a downstream element 190 in this embodiment, although in other embodiments the first outlet port 174 may permit flow to a different element or circuit than the element or circuit that receives flow from the second valve 150. As noted above, the downstream element 190 is a bi-directional hydraulic motor and, optionally, a variable displacement hydraulic motor in the illustrated embodiment. Thus, the hydraulic fluid that flows from the first outlet port 174 of the third valve 170 operates to rotate the hydraulic motor and, more specifically, the output shaft (not illustrated) of the hydraulic motor 190 in a second direction that is different and from the first direction that the hydraulic motor 190 operates under the influence of hydraulic fluid from the second valve 150. In the illustrated embodiment, the second valve 150 and the third valve 170 operate the hydraulic motor 190 in opposite directions (e.g., clockwise and counter-clockwise).

Referring back to the third valve 170, it also includes at least a second inlet port 175 connected to the motor 190 in certain valve positions and at least a second outlet port 176 connected to the tank 120. (Additional inlet and outlet ports beyond the first and second inlet ports 172, 175 and the first and second outlet ports 174, 176 fall within the scope of the disclosure.) The second outlet port 176 achieves the relieving function of the reducing-relieving valve because it too is configured to return excess hydraulic fluid from the motor 190 to the tank 120. Like the first valve 130 and the second valve 150, the relieving function of the third valve 170 protects downstream elements from excessive flow and/or pressure.

The third valve 170 optionally includes a spring 178 that applies a spring force to adjust the third valve 170 to achieve a desired minimum operating condition, such as a selected pressure reduction between the first pressure upstream of the valve 170 (i.e., downstream of the first valve 130) and the third pressure downstream of the first outlet port 174.

Like the second valve 150, in some embodiments the third valve 170 is an electrically activated or electrically actuated valve. For example, the third valve 170 optionally includes a solenoid 180, thus making the third valve 170 a solenoid actuated valve. The force that the solenoid 180 exerts on the second valve 170 works in conjunction with the spring force of the spring 178 in the illustrated embodiment. In different embodiments of the third valve 170, however, the force that the solenoid 180 applies opposes the spring force depending on the desired default condition/performance of the third valve 170. In addition, the solenoid 180 optionally is variable or adjustable solenoid that allows for selective control of the solenoid 180.

The solenoid 180 also is configured to receive an actuation signal$_t$ 780 from a controller 750 (FIG. 7 discussed below) to adjust the position of the solenoid 180 and, consequently, the position of the first outlet port 174 and the second outlet port 176 so as to alter the condition or performance of the third valve 170. In some embodiments, the actuation signal$_t$ 780 typically is a current, the magnitude of which is proportional to the desired force and/or movement that the solenoid 180 applies to the third valve 170. Of course, other embodiments might include an actuation signal$_t$ 780 that is another analog signal or a digital signal for a digital actuator. Thus, as will be discussed below further, the pressure drop across and/or the rate at which the hydraulic fluid flows out of the first outlet port 174 and the second outlet port 176 may be controlled by applying an actuation signal$_t$ 780 that is a function of, and typically proportional to, an input signal 722 that an operator provides to an input device 720. In addition, the actuation signal$_t$ 780 that the third valve 170 receives may be the same as, opposite to, or simply different from the actuation signal$_t$ 780 that the second valve 150 receives.

It will thus be understood that the third valve 170 also operates to permit the flow of hydraulic fluid from the first outlet port 174 at a pressure drop that is proportional to an actuation signal provided to the solenoid 180 while limiting and, in some instances, preventing the flow of hydraulic fluid from the second outlet port 176. As an operator wishes to change the performance or output of the downstream element 190 to which the first outlet port 174 is connected, the third valve 170 operates under the influence of the spring 178 and/or the solenoid 180 to increase or decrease the pressure of the hydraulic fluid from the first outlet port 174 from a minimum operating pressure to full pressure (i.e., 100% of available pressure). Concurrently, the third valve 170 operates to increase or decrease the pressure of the hydraulic fluid from the second outlet port 176 from minimum relief pressure to full pressure (i.e., 100% of available pressure). Of course, it is possible to have intermediate positions in which the third valve 170 permits hydraulic fluid to flow at a portion of the available hydraulic pressure from both the first outlet port 174 and the second outlet port 176. Further, one of skill in the art will understand that regardless of the position of the third valve 170, manufacturing tolerances may still permit a pressure drop and/or a small amount of hydraulic fluid to from the second outlet port 176 in the first condition (100% flow from first outlet port 174) and, likewise, a pressure drop and/or a small amount of hydraulic fluid to from the first outlet port 174 in the second condition (0% flow from the first outlet port 174).

The third valve 170 optionally includes a pilot valve 182, or first pilot valve, that senses the pressure upstream of the first inlet port 172 and provides that pressure to the spring 178 and/or the solenoid 180. The pilot valve 182 operates in combination with the spring 178 and/or the solenoid 180 to adjust, i.e., control the opening and closing of the first outlet port 174 and the second outlet port 176 in response to a pressure upstream of the third valve 170. In the illustrated embodiment, the pilot valve 182 operates additively with the spring 178 and/or the solenoid 180, although in other embodiments the pilot valve 182 operates in opposition to the spring 178 and/or the solenoid 180.

Similarly, the third valve 170 optionally includes a pilot valve 184, or second pilot valve, in addition to or as an alternate to the pilot valve 182. The pilot valve 184 senses the pressure downstream of the first outlet port 174 and provides that pressure to the third valve 170 in opposition to the spring 178 and/or the solenoid 180. The pilot valve 184 operates in combination with the spring 178 and/or the solenoid 180 to adjust, i.e., control the opening and closing of the first outlet port 174 and the second outlet port 176 in response to a pressure downstream of the first outlet port 174. In the illustrated embodiment, the pilot valve 184 operates in opposition to the spring 178 and/or the solenoid 180, although in other embodiments the pilot valve 184 operates additively with the spring 178 and/or the solenoid 180.

The hydraulic circuit 100 optionally includes a connection 192 downstream of the first outlet port 154 of the second valve 150 and/or the first outlet port 174 of the third valve 170 that connects to the first valve 130. The connection 192 acts similarly to a pilot valve in that it provides hydraulic fluid at at least one of the second pressure and/or the third pressure to the spring 142. The pressure provided via the connection 192 operates in combination with the spring 142 to adjust, i.e., control the opening and closing of the first outlet port 134 and the second outlet port 136 in response to at least one of the second pressure downstream of the first outlet port 154 and the third pressure downstream of the first outlet 174 port. In the illustrated embodiment, the pressure provided by the connection 192 operates additively with the spring 142, although in other embodiments the pressure provided by the connection 192 operates in opposition to the spring 142.

Optionally, the hydraulic circuit 100 includes a shuttle valve 194 as part of the connection 192, i.e., downstream of and connected to the first outlet port 154 of the second valve 150 and the first outlet port 174 of the third valve 170. The shuttle valve 194 is configured to sense the second pressure downstream of the first outlet port 154 and the third pressure downstream of the first outlet port 174. The shuttle valve 194 then permits hydraulic fluid associated with the higher of the second pressure and the third pressure to flow to the first valve 130. In so doing, the pressure provided to the first valve 130 provides a resultant force to the first valve 130 that is additive in this embodiment with the spring force provided by the spring 142.

In some embodiments, the hydraulic circuit 100 includes a fourth valve 200 positioned downstream of at least one of the first outlet port 154 of the second valve and the first outlet port 174 of the third valve 170. In particular, the fourth valve 200 is positioned between the shuttle valve 194 and at least one of the first valve 130 and the tank 120.

In a first position, the fourth valve 200 includes a first inlet port 202 that is connected to the first valve 130 via a connection 213. In addition, in the first position a first outlet port 204 is connected downstream of the second outlet port 156 of the second valve 150 and, consequently to the tank 120. In this position, the fourth valve 200 acts like a pilot valve to the first valve 130 and provides a sense of the reservoir or tank pressure at the tank 120 to the first valve 130. Of course, one of skill in the art would understand that the fourth valve 200 could be coupled to the third valve 170 in the manner as, but alternatively to, the second valve 150. In this first position, the fourth valve 200 prevents the flow of hydraulic fluid from the shuttle valve 194 to the first valve 130 and/or the tank 120.

The fourth valve 200 includes a second position in which a second inlet port 206 is connected downstream of at least one of the first outlet port 154 of the second valve 150 and the first outlet port 174 of the third valve 170 and, more particularly, downstream of the shuttle valve 194. A second outlet port 208 is connected to at least one of the first valve 130 via the connection 213 and the tank 120. (It should be noted that while the application refers to the second inlet port 206 and the second outlet port 208, one or both of the second inlet port 206 and the second outlet port 208 may be bi-directional, i.e., permitting flow in and out. In the embodiment in FIG. 2, both the second inlet port 206 and the second outlet port 208 are bi-directional. Nonetheless, for convenience and clarity we will continue to refer to the second inlet port 206 and the second outlet port 208 despite the bi-directional flow permitted in each port.) In this second position, the fourth valve 200 acts like a pilot valve to the first valve 130 and provides a sense of at least one of the second pressure downstream of the first outlet port 154 of the second valve 150 and the third pressure downstream of the first outlet port 174 of the third valve 170 as discussed above. In so doing, the pressure provided to the first valve 130 provides a resultant force to the first valve 130 that is additive in this embodiment with the spring force provided by the spring 142.

The fourth valve 200 optionally includes a spring 210 that applies a spring force to adjust the fourth valve 200 to either the first position or the second position as desired. In the particular embodiment, the spring 210 biases the fourth valve 200 to the first position.

Optionally, the fourth valve 200 is an electrically activated or electrically actuated valve. For example, the fourth valve 200 optionally includes a solenoid 212, thus making the fourth valve 200 a solenoid actuated valve. The force that the solenoid 212 exerts on the fourth valve 200 works in opposition to the spring force of the spring 210 in the illustrated embodiment. In different embodiments of the fourth valve 200, however, the force that the solenoid 212 applies works additively with the spring force depending on the desired default condition/performance of the fourth valve 200. In addition, the solenoid 212 optionally is a variable or adjustable solenoid that allows for selective control of the solenoid 212, although in the illustrated embodiment the solenoid 212 is not variable and/or adjustable.

The solenoid 212 is configured to receive an enablement signal from a controller 750 (FIG. 7 as discussed below) to adjust the position of the solenoid 212 and, consequently, the position of the first inlet port 202, the first outlet port 204, the second inlet port 206, and the second outlet port 208 so as to alter the position and performance of the fourth valve 200. In some embodiments, the enablement signal 726 typically is a current, although other embodiments might include an enablement signal 726 that is another analog signal or a digital signal for a digital actuator. An operator that manipulates an enablement device 724, such as an "On/Off" button or something similar, would thus cause the controller 750 to transmit the enablement signal to the fourth valve 200, thereby actuating the solenoid 212 to a second position that permits the flow of hydraulic fluid through the hydraulic circuit 100.

Optionally, the hydraulic circuit 100 includes a pressure accumulation device 220 downstream of at least one of the first outlet port 154 of the second valve 150 and the first outlet port 174 of the third valve 170 and upstream or before the first valve 130. More particularly, and as illustrated in FIG. 2, the pressure accumulation device 220 is positioned downstream of the second outlet port 208 of the fourth valve 200 and upstream of the first valve 130 along the connection 213. The pressure accumulation device 220 may be an accumulator of any of the various types known in the art or, in some instances, may be as simple as length of tubing open at one end and configured to provide a u-tube type structure and function.

In some embodiments, the pressure accumulation device 220 acts to store hydraulic fluid and to delay the arrival time of the flow and consequent pressure to the first valve 130. A reason to provide such a delay is in the event that the time constant of the first valve is similar to or identical with the time constant of at least one of the second valve and the third valve. Generally, the time constant of a valve is the time that it takes for the valve to travel from a zero position to at least two-thirds of the valves rated full travel when a full signal is applied. As the first valve 130 is operatively connected and responsive to at least one of the second valve 150 and the third valve 170 as discussed above, if the time constants of these valves are too similar it could result in the first valve 130 "chasing" the response of the second valve 150 or the third valve 170. Such chasing could potentially result in uneven responses, such as failing to reach a steady state condition. Thus, the pressure accumulation device, by introducing a small delay in the time in which the first valve 130 receives the pressure signal from the second valve 150 or the third valve 170, reduces or eliminates the risk that the first valve 130 would be "chasing" the other valves.

The hydraulic circuit 100 also optionally includes at least one flow restriction 230 downstream of at least one of the first outlet port 154 of the second valve 150 and the first outlet port 174 of the third valve 170 and upstream or before the first valve 130. The flow restriction 230 provides hydraulic resistance that controls the response rate of valve 130 in conjunction with pressure accumulation device 220.

The hydraulic circuit 100 also optionally includes at least one flow restriction 240 downstream of at least one of the second outlet port 156 of the second valve 150 and the second outlet port 176 of the third valve 170 and upstream or before the tank 120. Alternatively, the flow restriction 240 optionally is formed integrally within at least one of the second outlet port 556 of the second valve 550 and the second outlet port 576 of the third valve 570, as discussed below and illustrated in FIG. 5. As with the flow restriction 230, the flow restriction 240 provides a back-pressure upstream of the flow restriction 240. This back pressure varies as a function of the flow rate through the flow restriction 240. The flow rate through flow restriction 240 is, in some embodiments, substantially the same as the flow rate through motor 190. Thus, the backpressure on the motor 190 is proportional to the flow rate through the motor 190 and the relief pressure at the second outlet 156, 176 of second valve and third valve 150, 170 respectively, depending on the direction that the motor is operating.

Figure 4:
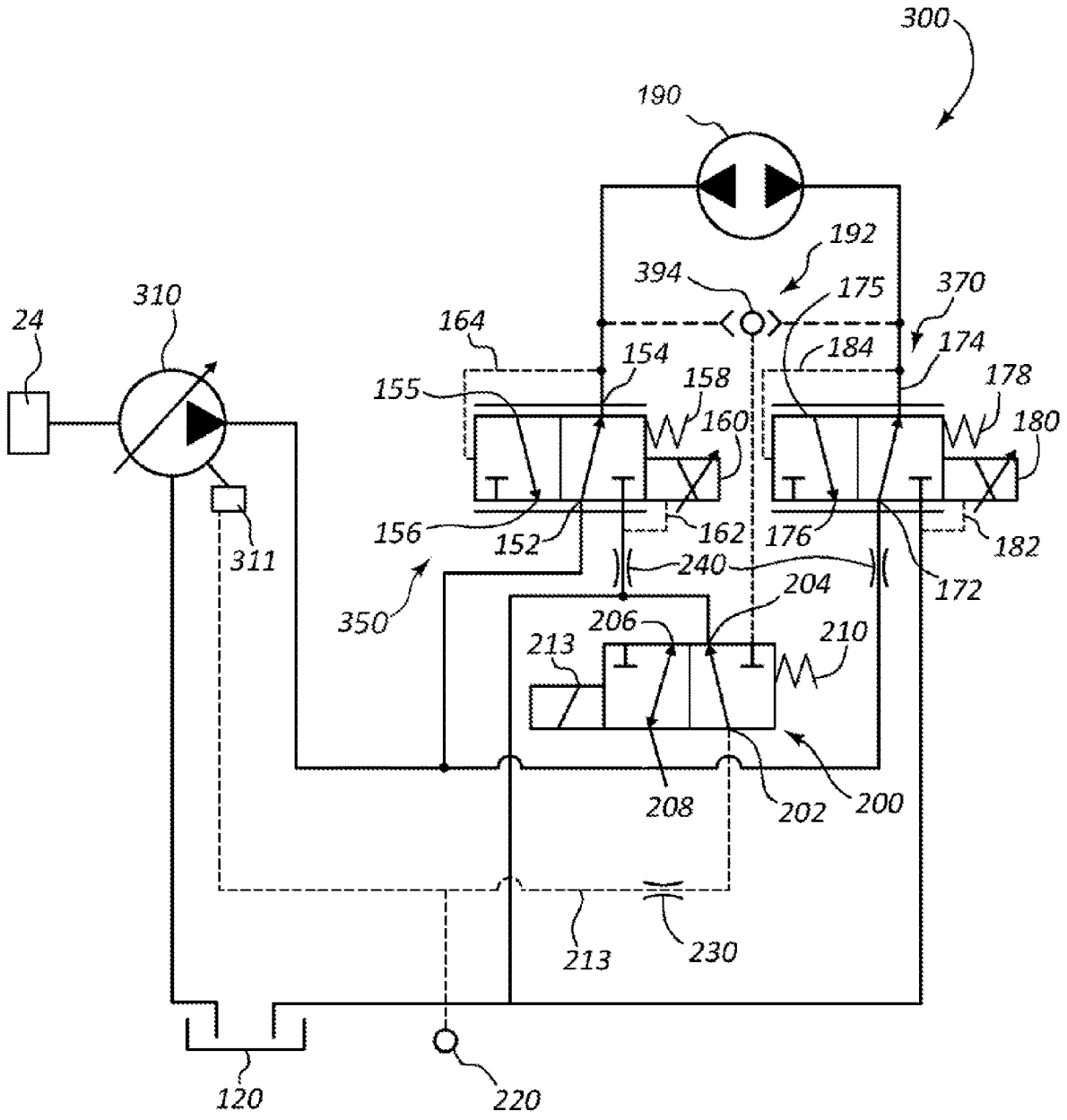
FIG. 4 is another embodiment of a hydraulic circuit.

Another embodiment of a hydraulic circuit 300 is illustrated in FIG. 4. The hydraulic circuit 300 is quite similar to the hydraulic circuit 100 and, indeed, uses many of the same elements configured in the same manner as those in the hydraulic circuit 100. Consequently, those elements that are the same between the hydraulic circuit 100 and the hydraulic circuit 300 use the same element numbers. In addition, one should refer to the relative paragraphs above for the description of a particular identical element.

Referring to FIG. 4, then, the differences between the hydraulic circuit 100 and the hydraulic circuit 300 are now discussed. The hydraulic circuit 300 employs at least one variable displacement hydraulic pump 310 connected to the power source 24 and to the tank 120 that provides the hydraulic circuit 300 with a hydraulic fluid and receives hydraulic fluid from the hydraulic circuit 300. The hydraulic pump 310 provides a flow of hydraulic fluid to the hydraulic circuit 300 at an initial pressure. The hydraulic pump 310 optionally includes a controller 311 that is sensitive and responsive to pressure.

The hydraulic circuit 300, unlike the hydraulic circuit 100, does not include a first valve 130. Rather, the hydraulic circuit 300 includes a first valve 350 that is identical to the second valve 150 in the first hydraulic circuit 100. Consequently, those sub-elements of the first valve 350 that are identical to the sub-elements of the second valve 150 use the same element number. Likewise, the hydraulic circuit 300 includes at least a second valve 370 that is identical to the third valve 170 in the first hydraulic circuit 100. Consequently, those sub-elements of the second valve 370 that are identical to the sub-elements of the third valve 170 use the same element number.

The first inlet port 152 of the first valve 350 is connected to the variable displacement hydraulic pump 310. The first outlet port 154 is configured to reduce the initial pressure to a first pressure downstream of the first outlet port 154. The first outlet port 154 of the first valve 350 and the other features of the first valve 350 otherwise work and are coupled to the elements of the hydraulic circuit 300 as described above with respect to the second valve 150 of the hydraulic circuit 100.

The second valve 370 includes a first inlet port 172 connected to the variable displacement hydraulic pump 310 and, optionally, in parallel with the first inlet 152 of the first valve 350. The first outlet port 174 also is configured to reduce the initial pressure to a second pressure downstream of the first outlet port 174. The first outlet port 174 of the second valve 370 and the other features of the second valve 370 otherwise work and are coupled to the elements of the hydraulic circuit 300 as described above with respect to the second valve 170 of the hydraulic circuit 100.

Hydraulic circuit 300 includes a shuttle valve 394 downstream of and connected to the first outlet port 154 of the first valve 350 and the first outlet port 174 of the second valve 370. The shuttle valve 394 is configured to sense the first pressure downstream of the first outlet port 154 and the second pressure downstream of the second outlet port 174 and permits the hydraulic fluid associated with the higher of the first pressure and the second pressure to flow to the controller 311 which senses and/or detects the pressure. A flow restriction 230 is downstream of at least one of the first outlet port 154 of the second valve 350 and the first outlet port 174 of the third valve 370 and upstream or before the controller 311. The controller 311 responds to the pressure that it receives and adjusts the variable displacement hydraulic pump 310 to maintain, increase, or decrease the flow rate accordingly.

Figure 5:
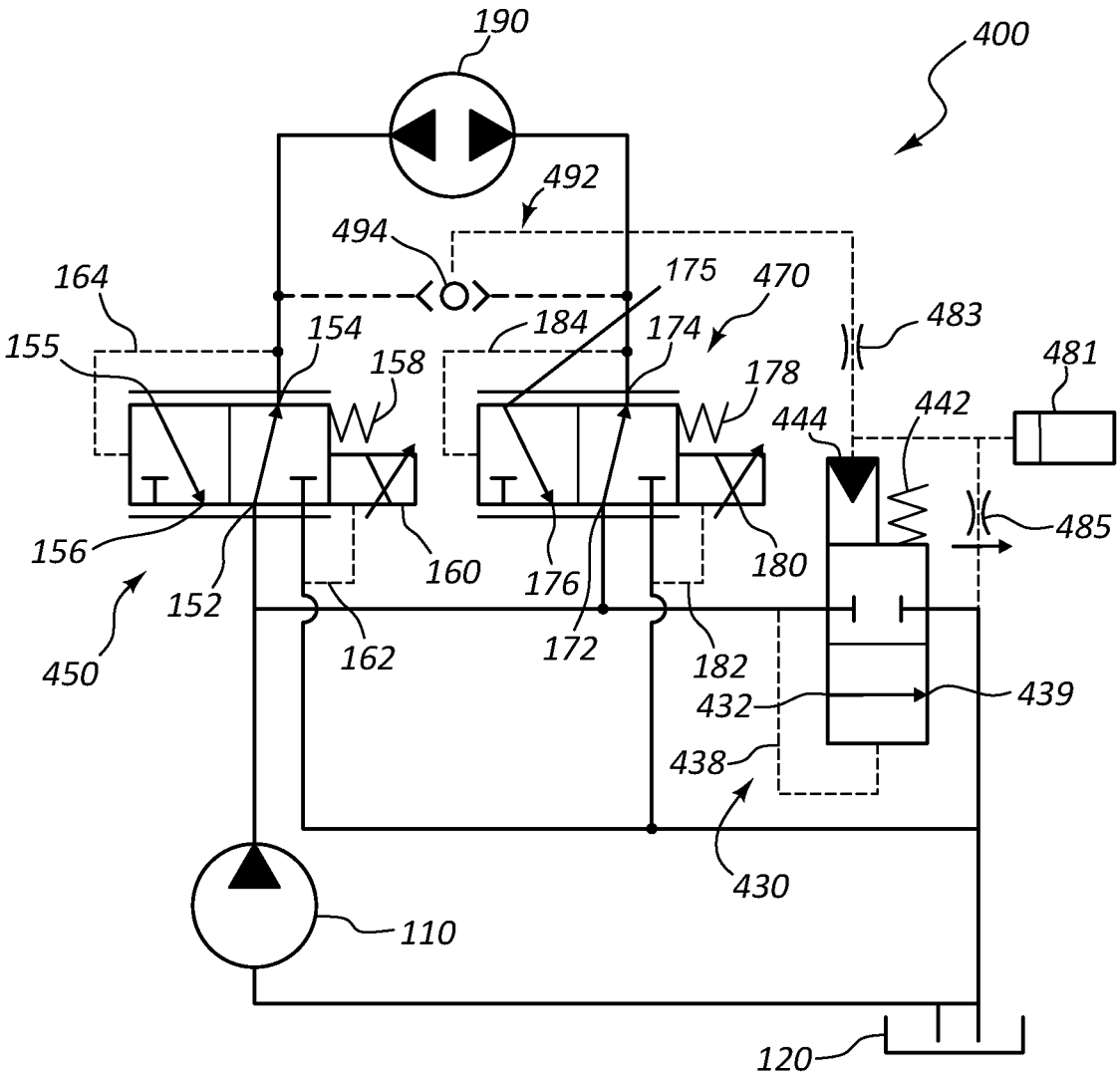
FIG. 5 is another embodiment of a hydraulic circuit.

Another embodiment of a hydraulic circuit 400 is illustrated in FIG. 5. The hydraulic circuit 400 is similar to the hydraulic circuit 100 and, indeed, uses many of the same elements configured in the same manner as those in the hydraulic circuit 100. Consequently, those elements that are the same between the hydraulic circuit 100 and the hydraulic circuit 400 use the same element numbers. In addition, one should refer to the relative paragraphs above for the description of a particular identical element.

Referring to FIG. 5, then, the differences between the hydraulic circuit 100 and the hydraulic circuit 400 are now discussed. The hydraulic circuit 400 employs at least one hydraulic pump 110 connected to a power source (not illustrated) and to the tank 120 that provides the hydraulic circuit 400 with a hydraulic fluid and receives hydraulic fluid from the hydraulic circuit 400. The hydraulic pump 110 provides a flow of hydraulic fluid to the hydraulic circuit 400 at an initial pressure.

The hydraulic circuit 400, unlike the hydraulic circuit 100, does not include a first valve 130. Rather, the hydraulic circuit 400 includes a first valve 450 that is identical to the second valve 150 in the first hydraulic circuit 100. Consequently, those sub-elements of the first valve 450 that are identical to the sub-elements of the second valve 150 use the same element number. Likewise, the hydraulic circuit 400 includes at least a second valve 470 that is identical to the third valve 170 in the first hydraulic circuit 100. Consequently, those sub-elements of the second valve 470 that are identical to the sub-elements of the third valve 170 use the same element number.

The first inlet port 152 of the first valve 450 is connected to the hydraulic pump 310. The first outlet port 154 is configured to reduce the initial pressure to a first pressure downstream of the first outlet port 154. The first outlet port 154 of the first valve 450 and the other features of the first valve 450 otherwise work and are coupled to the elements of the hydraulic circuit 400 as described above with respect to the second valve 150 of the hydraulic circuit 100.

The second valve 470 includes a first inlet port 172 connected to the hydraulic pump 110 and, optionally, in parallel with the first inlet 152 of the first valve 450. The first outlet port 174 also is configured to reduce the initial pressure to a second pressure downstream of the first outlet port 174. The first outlet port 174 of the second valve 470 and the other features of the second valve 470 otherwise work and are coupled to the elements of the hydraulic circuit 400 as described above with respect to the second valve 170 of the hydraulic circuit 100.

Hydraulic circuit 400 includes a shuttle valve 494 downstream of and connected to the first outlet port 154 of the first valve 450 and the first outlet port 174 of the second valve 470. The shuttle valve 494 is configured to sense the first pressure downstream of the first outlet port 154 and the second pressure downstream of the second outlet port 174 and permits the hydraulic fluid associated with the higher of the first pressure and the second pressure to flow to a third valve 430 discussed below.

The hydraulic circuit 400 includes a third valve 430 that, optionally, is an unloader style valve with some similarities to the first valve 130. The third valve 430 is connected to the hydraulic pump 110 in parallel with the first valve 450 and the second valve 470. The third valve 430 is configured to maintain a pressure in the hydraulic circuit 400 upstream of the third valve below a threshold pressure.

The third valve 430 includes at least one inlet port 432 and at least one outlet port 434. The third valve 430 includes a spring 442 that applies a spring force to maintain the third valve 430 in a first position during which the initial pressure is less than or equal to the threshold pressure the flow of hydraulic fluid is prohibited from entering the inlet port 432. Once the threshold pressure is reached, however, the third valve 430 moves to a second position in which the inlet port 432 is connected to the hydraulic pump 110 and the outlet port 434 is connected to the tank 120, thereby allowing any excess hydraulic fluid to return through the outlet port 434 to the tank 120. Of course, in other embodiments the spring 442 may be oriented to provide a different default or standard operating position or condition. Further, one of skill in the art will understand that regardless of the position of the first valve 430, manufacturing tolerances may still permit a pressure drop and/or a small amount of hydraulic fluid to flow from the outlet port 434 in the first condition, for example.

The third valve 430 optionally includes a pilot valve 438 that senses the pressure upstream of the third valve 430. The pilot valve 438 operates in combination with the spring 442 that adjusts, i.e., controls the opening and closing of the inlet port 432 and the outlet port 434 in response to a pressure upstream of the first valve 430 and the spring force applied by the spring 442. In the illustrated embodiment, the pilot valve 438 operates in opposition to the spring 442, although in other embodiments the pilot valve 438 operates additively to the spring 442.

Optionally, the third valve 430 includes a hydraulically actuated pilot valve 444. The force that the hydraulically actuated pilot valve 444 exerts on the third valve 430 works in conjunction with the spring force of the spring 442 in the illustrated embodiment. In different embodiments of the third valve 430, however, the force that the hydraulically actuated pilot valve 444 applies opposes the spring force depending on the desired default position/performance of the third valve 430. In addition, the hydraulically actuated pilot valve 444 optionally is variable or adjustable, thus allowing for selective control of the hydraulically actuated pilot valve 444.

The hydraulic circuit 400 optionally includes a connection 492 downstream of the first outlet port 154 of the first valve 450 and/or the first outlet port 154 of the second valve 470 that connects to the third valve 430. The connection 492 acts similarly to a pilot valve in that it provides hydraulic fluid at at least one of the first pressure and/or the second pressure to the spring 442 and/or the hydraulically actuated pilot valve 444. The pressure provided via the connection 492 operates in combination with the spring 442 and/or the hydraulically actuated pilot valve 444 to adjust, i.e., control the opening and closing of the inlet port 432 and the outlet port 434 in response to at least one of the first pressure downstream of the first outlet port 154 and the second pressure downstream of the first outlet 174 port. In the illustrated embodiment, the pressure provided by the connection 492 operates additively with the spring 442 and/or the hydraulically actuated pilot valve 444, although in other embodiments the pressure provided by the connection 492 operates in opposition to the spring 442 and/or the hydraulically actuated pilot valve 444.

Optionally, the hydraulic circuit 400 includes a shuttle valve 494 as part of the connection 492, i.e., downstream of and connected to the first outlet port 154 of the first valve 450 and the first outlet port 174 of the second valve 470. The shuttle valve 494 is configured to sense the first pressure downstream of the first outlet port 154 and the second pressure downstream of the first outlet port 174. The shuttle valve 494 then permits hydraulic fluid associated with the higher of the first pressure and the second pressure to flow to the third valve 430. In so doing, the pressure provided to the third valve 430 provides a resultant force to the third valve 430 that is additive in this embodiment with the spring force provided by the spring 442 and/or the hydraulically actuated pilot valve 444.

Optionally, the hydraulic circuit 400 includes a pressure accumulation device 481 downstream of at least one of the first outlet port 154 of the first valve 450 and the first outlet port 174 of the second valve 470 and upstream or before the third valve 430.

The hydraulic circuit 400 also optionally includes at least one flow restriction 483 downstream of at least one of the first outlet port 154 of the first valve 450 and the first outlet port 474 of the second valve 470 and upstream or before at least one of the third valve 430 and the tank 120. In the embodiment illustrated, the flow restriction 483 is positioned upstream of the third valve 430 and another flow restriction 485, which optionally may be an adjustable restriction, is positioned downstream of the flow restriction 483 and before the tank 120.

Figure 6:
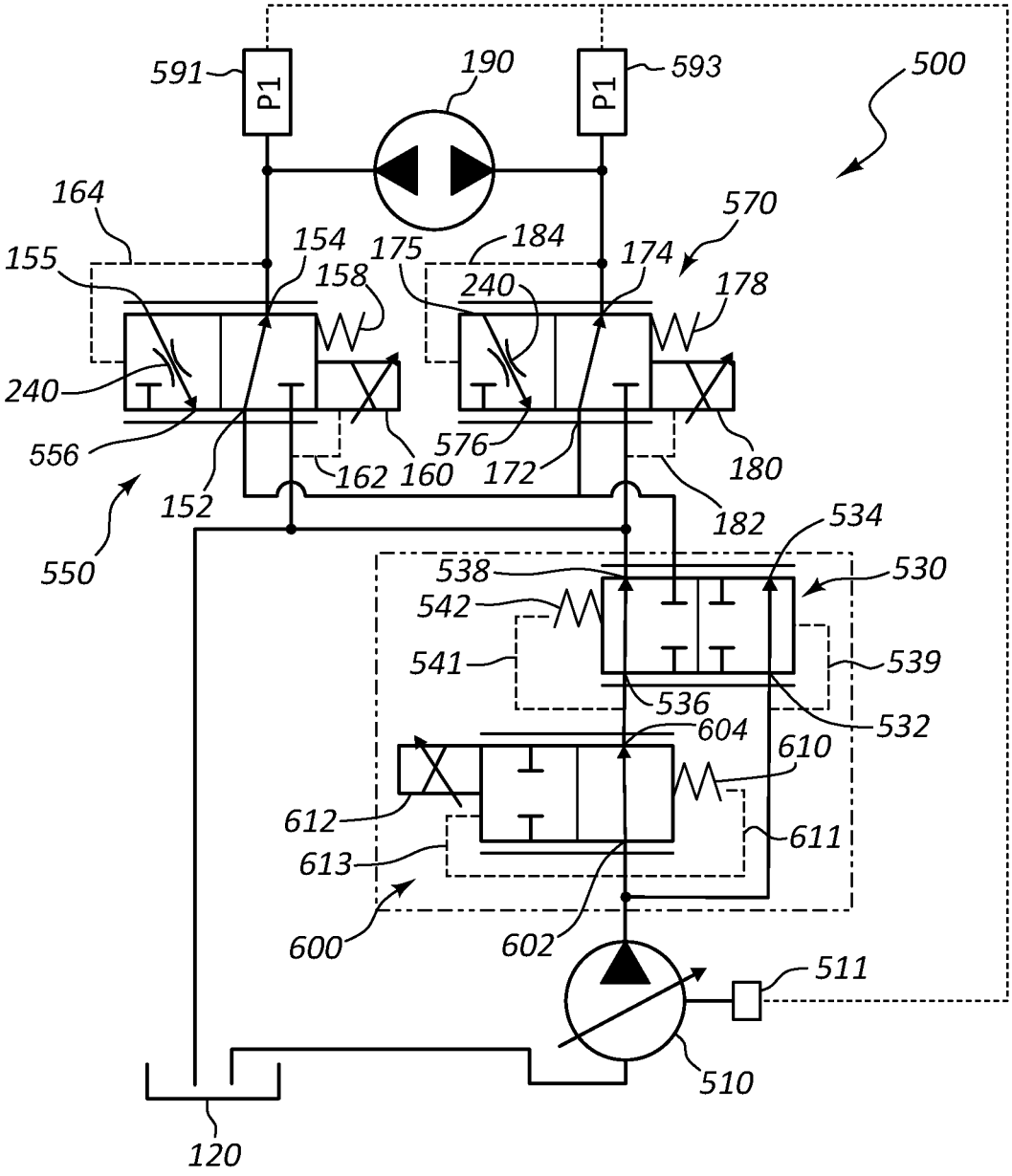
FIG. 6 is another embodiment of a hydraulic circuit.

Another embodiment of a hydraulic circuit 500 is illustrated in FIG. 6. The hydraulic circuit 500 is similar to the hydraulic circuit 100 and, indeed, uses many of the same elements configured in the same manner as those in the hydraulic circuit 100. Consequently, those elements that are the same between the hydraulic circuit 100 and the hydraulic circuit 500 use the same element numbers. In addition, one should refer to the relative paragraphs above for the description of a particular identical element.

Referring to FIG. 6, then, the differences between the hydraulic circuit 100 and the hydraulic circuit 500 are now discussed. The hydraulic circuit 500 employs at least one variable displacement hydraulic pump 510 connected to the power source (not illustrated) and to the tank 120 that provides the hydraulic circuit 500 with a hydraulic fluid and receives hydraulic fluid from the hydraulic circuit 500. The hydraulic pump 510 provides a flow of hydraulic fluid to the hydraulic circuit 500 at an initial pressure. The hydraulic pump 510 optionally includes a controller 511 that is sensitive and responsive to pressure.

The hydraulic circuit 500 includes a first valve 530 that has a similar function and similar features as the first valve 130, and an enablement valve 600 that has similar function and similar features as the fourth valve 200. The enablement valve 600 is positioned in series between the hydraulic pump 510 and the first valve 530. Collectively, the first valve 530 and the enablement valve 600 act as an electro-proportional solenoid valve.

A first valve 530 is configured to maintain at least a first pressure in the hydraulic circuit 500 downstream of the first valve 530. The first valve 530 includes a first inlet port 532 that is directly connected to the hydraulic pump 510 and a first outlet port 534, as well as at least a second inlet port 536 that is indirectly connected to the hydraulic pump 510 and at least a second outlet port 538 connected to the tank 120.

The first valve 530 includes a spring 542 that applies a spring force to adjust the first valve 530 so that when the initial pressure is less than the first pressure the first valve is in a position to prevent the flow to exit from the first outlet 534. Rather, the flow of hydraulic fluid enters the second inlet port 534 and exits the second outlet port 538 and returns to the tank 120. When the initial pressure is equal to or greater than the first pressure the first valve 530 moves to its second position in which the hydraulic fluid flows into the first inlet 532 and exits the first outlet port 534 and onto the downstream portions of the hydraulic circuit, including the second valve 550 and the third valve 570 as will be discussed below. Of course, in other embodiments the spring 542 may be oriented to provide a different default or standard operating position or condition (e.g., default to have hydraulic fluid flow to the second valve 550 and the third valve 570 rather than initially to the tank 120).

The first valve 530 optionally includes a pilot valve 539 that senses the pressure upstream of the first inlet port 532. The pilot valve 539 operates in combination with the spring 542 that adjusts, i.e., controls the opening and closing of the first outlet port 534 and the second outlet port 538 in response to a pressure upstream of the first inlet port 532 and the spring force applied by the spring 542. In the illustrated embodiment, the pilot valve 539 operates in opposition to the spring 542, although in other embodiments the pilot valve 539 operates additively to the spring 542.

The first valve 530 also optionally includes a pilot valve 541 that senses the pressure upstream of the second inlet port 536. The pilot valve 541 operates in combination with the spring 542 that adjusts, i.e., controls the opening and closing of the first outlet port 534 and the second outlet port 538 in response to a pressure upstream of the second inlet port 536 and the spring force applied by the spring 542. In the illustrated embodiment, the pilot valve 541 operates additively to the spring 542, although in other embodiments the pilot valve 541 operates in opposition to the spring 542.

As noted, the hydraulic circuit 500 optionally includes the enablement valve 600 positioned downstream of the hydraulic pump 510 and upstream as well as in series with the first valve 530.

In a first position, the enablement valve 600 includes an inlet port 602 that is connected to the hydraulic pump 510 and an outlet port 604 that is connected to the second inlet port 536 of the first valve 530. In this first position, the enablement valve 600 typically sends any flow from the hydraulic pump 510 to the tank 120 through the first valve 530.

The enablement valve 600 includes a second position that prevents the flow from the hydraulic pump 510 from entering the inlet port 602. That is, any flow is diverted entirely to the first inlet 532 of the first valve 530.

The enablement valve 600 optionally includes a spring 210 that applies a spring force to adjust the enablement valve 600 to either the first position or the second position as desired. In the particular embodiment, the spring 610 biases the enablement valve 600 to the first position.

The enablement valve 600 optionally includes a pilot valve 611 that senses the pressure upstream of the inlet port 602. The pilot valve 611 operates in combination with the spring 610 that adjusts, i.e., controls the opening and closing of the inlet port 602 and the outlet port 604 in response to a pressure upstream of the inlet port 602 and the spring force applied by the spring 610. In the illustrated embodiment, the pilot valve 611 operates additively with the spring 610, although in other embodiments the pilot valve 610 operates in opposition to the spring 610.

Optionally, the enablement valve 600 is an electrically activated or electrically actuated valve. For example, the enablement valve 600 optionally includes a solenoid 612, thus making the enablement valve 600 a solenoid actuated valve. The force that the solenoid 612 exerts on the enablement valve 600 works in opposition to the spring force of the spring 610 in the illustrated embodiment. In different embodiments of the enablement valve 600, however, the force that the solenoid 612 applies works additively with the spring force depending on the desired default condition/performance of the enablement valve 600. In addition, the solenoid 612 optionally is a variable or adjustable solenoid that allows for selective control of the solenoid 612 as indicated in FIG. 5.

The solenoid 612 is configured to receive an enablement signal 726 from a controller 750 (FIG. 7 and discussed below) to adjust the position of the solenoid 612 and, consequently, the position of the inlet port 602 and the outlet port 604 so as to alter the position and performance of the enablement valve 600. In some embodiments, the enablement signal 726 typically is a current, although other embodiments might include an enablement signal 726 that is another analog signal or a digital signal for a digital actuator. An operator that manipulates an enablement device 724, such as an "On/Off" button or something similar, would thus cause the controller 750 to transmit the enablement signal 726 to the enablement valve 600, thereby actuating the solenoid 612 to a second position that permits the flow of hydraulic fluid through the hydraulic circuit 500.

The enablement valve 600 optionally includes another pilot valve 613 that senses the pressure upstream of the inlet port 602. The pilot valve 613 operates in combination with the solenoid 612 that adjusts, i.e., controls the opening and closing of the inlet port 602 and the outlet port 604 in response to a pressure upstream of the inlet port 602 and the solenoid 612. In the illustrated embodiment, the pilot valve 613 operates additively with the solenoid 612, although in other embodiments the pilot valve 613 operates in opposition to the solenoid 612.

As noted, the hydraulic circuit 500 includes a second valve 550 that is nearly identical to the second valve 150 in the first hydraulic circuit 100. Consequently, those sub-elements of the second valve 450 that are identical to the sub-elements of the second valve 150 use the same element number. Likewise, the hydraulic circuit 500 includes at least a third valve 570 that is nearly identical to the third valve 170 in the first hydraulic circuit 100. Consequently, those sub-elements of the third valve 570 that are identical to the sub-elements of the third valve 170 use the same element number.

The first inlet port 152 of the second valve 550 is connected to the first outlet port 534 of the first valve 530. The first outlet port 154 is configured to reduce the initial pressure to a second pressure downstream of the first outlet port 154.

The second valve 550 includes a second outlet 556 that connects to the tank 120. Optionally, the second outlet 556 integrally includes a flow restriction 240 as discussed above in greater detail as it relates to the hydraulic circuit 100 and FIG. 2.

The other features of the second valve 550 otherwise work and are coupled to the elements of the hydraulic circuit 500 as described above with respect to the second valve 150 of the hydraulic circuit 100.

The first inlet port 172 of the third valve 570 also is connected to the first outlet port 534 of the first valve 530 and is positioned parallel to the first inlet port 152 of the second valve 550. The first outlet port 174 is configured to reduce the initial pressure to a third pressure downstream of the first outlet port 174.

The third valve 570 includes a second outlet 576 that connects to the tank 120. Optionally, the second outlet 576 integrally includes a flow restriction 240 as discussed above in greater detail as it relates to the hydraulic circuit 100 and FIG. 2.

The other features of the third valve 570 otherwise work and are coupled to the elements of the hydraulic circuit 500 as described above with respect to the third valve 170 of the hydraulic circuit 100.

In contrast to the hydraulic circuit 100, the hydraulic circuit 500 does not include a shuttle valve. Rather, the hydraulic circuit 500 includes a first pressure sensor 591 is downstream and connected to the first outlet 154 of the second valve 550. The first pressure sensor 591 is configured to generate a first signal reflective of the pressure at the first outlet port 154.

The hydraulic circuit 500 also includes a second pressure sensor 593 that is downstream and connected to first outlet 174 of the second valve 570. The second pressure sensor 593 is configured to generate a second signal reflective of the pressure at the first outlet port 174.

The controller 511 is configured to receive the first signal and the second signal and to calculate a differential signal reflective of a differential pressure between the pressure at the first outlet port of the second valve and the pressure at the first outlet port of the third valve. The controller [[311]] 511 converts the differential signal into a pump signal that the controller 511 sends to the variable displacement hydraulic pump 510 to adjust the hydraulic flow of the pump in response to the pump signal. Alternatively, rather than a dedicated controller 511, the controller 750 (FIG. 7 as discussed below) can be configured to perform the same function as the controller 511.

Figure 7:
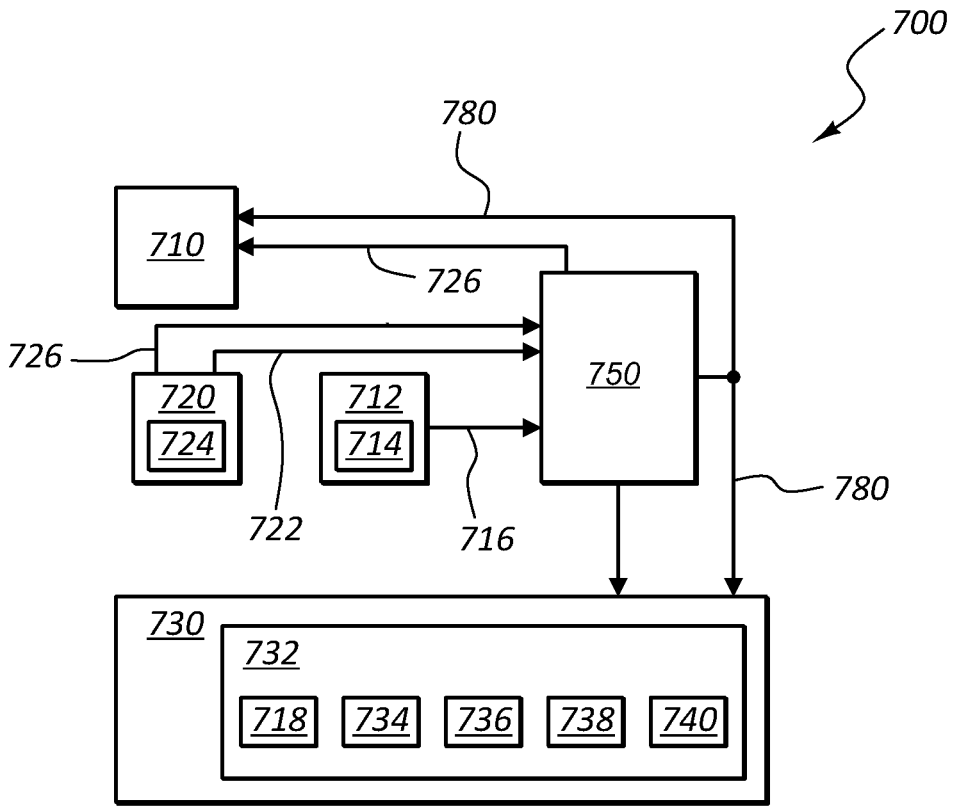
FIG. 7 is a flow chart of a control system for operating embodiments of a hydraulic circuit.

Also disclosed are embodiments of a control system for a hydraulic circuit, particularly one that controls a hydraulic motor in a construction machine, as described below and illustrated in FIG. 7. The control system 700 is suitable for controlling a hydraulic circuit 710, which may be an embodiment of the hydraulic circuits described above.

The control system 700 includes at least one power source 712 that includes an output sensor 714 to detect an output of the power source 712. For example, the power source 712 typically is an internal combustion engine, such as a diesel engine, although in other instances the power source 712 might be an electric current provide by batteries, an alternator driven by an internal combustion engine, an electric motor, and the like. The output sensor 714 may be any time of sensor that measures the output of the power source 712, whether that measurement is made directly or indirectly. For example, the output sensor 714 might measure the current, the revolutions per minute of a shaft, and other such methods. The output sensor 714 generates an output signal 716 reflective of the power output.

The control system 700 includes an input device 720 that generates an input signal 722 reflective of a position of the input device as an operator manipulates the input device 720. For example, a typical input device might be a joystick, although other input devices include a computer mouse, track ball, levers, paddles, peddles, keyboards, touch screens and others. Typically, the input device 720 is located within the operator's cab 60 (FIG. 1) although it could be a remote input device, such as those that are often used with self-erecting mobile tower cranes.

The control system 700 also includes a memory storage device 730 configured to store an operating program 732. The memory storage device 730 includes various types of recordable media, including random access memory, read only memory, removable media, as well as a hard-wired specific instruction chip, and other known types. In addition, the memory storage device 730 may be a separate element or it may be incorporated into a computer system or controller 750, as described below.

The operating program 732 is configured to calculate an actuation signal$_t$ 780, which denotes the actuation signal at a time "t". The actuation signal$_t$ 780 is a function of at least one the input signal 722, the output signal 716, and an actuation signal$_{t-1}$ 718, which is the actuation signal at a time "t−1", i.e., a previously generated actuation signal and, typically, the actuation signal most recently calculated before the present iteration of the operating program 732. The actuation signal$_{t-1}$ 718 typically would be stored at least temporarily in the memory storage device 730 for at least the purpose of the present calculation.

In addition, the operating program 732 may calculate actuation signal$_t$ 780 as a function of one or more correlations in a database (whether calculated or empirical), one or more look-up tables, and/or one or more gains that are part of the operating program 732. In addition, these various factors optionally are applied in any order, i.e., the various databases, tables, and/or gains are transitive. For example, the operating program 732 may include and apply, in no particular order the following non-limiting examples:

- a first database 734 that correlates the input signal 722 relative to time, i.e., what is the input signal 722 now relative to one or more input signals over a preceding period of time; this could be an operator defined curve to account for and to the sensitivity of the input device;
- a second database 736 that correlates the actuation signal$_{t-1}$ 718 to the input signal 722; this, for example, could be the steady state condition of the input signal and consequent steady actuation signal$_{t-1}$ 718 and comparing that to a new input signal 722;
- a first gain 738 that allows an operator to selectively increase and decrease a magnitude of the calculated actuation signal$_t$ 780 relative to the input signal 722; for example, an operator may select a first gain that adjusts the calculated actuation signal$_t$ 780 to be proportionally larger or smaller than what one might otherwise predict for a given magnitude of the input signal 722;
- a second gain 740 that selectively increases and decreases the magnitude of the actuation signal$_t$ 780 relative to the magnitude of the output signal 716; in other words, the actuation signal$_t$ 780 is a function of the power available for output from the power source (e.g., a diesel engine at low idle provides less power than that same engine at full-throttle).

The control system 700 also includes a controller 750, such as a general purpose computer, specific purpose computer, reduced instruction set chips, and other known types of controllers and/or processors. The controller 750 receives at least one of the input signal 722 and the output signal 716 from the power source 712. The controller additionally calls or runs the operating program 732 in order to calculate actuation signal$_t$ 780. The controller 750 then transmits the calculated actuation signal$_t$ 780 to the hydraulic circuit 710 and, more specifically, at least one of the second valve 150 and the third valve 170 and its equivalents in the various embodiments described above.

In addition, the input device 720 may include an enablement device 724, such as "On/Off" toggle, switch, button, and the like, that generates an enablement signal 726. The operator engages the enablement device 724, which transmits the enablement signal 726 to the controller 750, which in turn transmits that enablement signal 726 to the hydraulic circuit 710 and, more specifically, the fourth valve 200 and/or the enablement valve 600, for example.

Optionally, the controller 750 can assume the function of the controller 311 and/or 511 for the variable displacement hydraulic pump 310 and 510, respectively, as one of skill in the art would appreciate.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A hydraulic circuit for use on a construction machine, said hydraulic circuit comprising:

a) at least one tank configured for providing hydraulic fluid to and receiving hydraulic fluid from said hydraulic circuit;

b) at least one hydraulic pump connected to said at least one tank, said hydraulic pump providing a flow of hydraulic fluid to said hydraulic circuit at an initial pressure;

c) a first valve that includes:

i. at least one inlet port connected to said hydraulic pump;

ii. a first outlet port over which said first valve is configured to reduce said initial pressure to a first pressure downstream of said first outlet port of said first valve;

iii. at least a second outlet port connected to said tank, said second outlet port configured to return excess hydraulic fluid to said tank;

d) at least a second valve that is in a parallel relationship to said first valve, said second valve including:

i. at least one inlet port connected to said hydraulic pump;

ii. a first outlet port over which said second valve is configured to reduce said initial pressure to a second pressure downstream of said first outlet port of said second valve;

iii. at least a second outlet port connected to said tank, said second outlet port configured to return excess hydraulic fluid to said tank;

e) a hydraulic motor connected to said first outlet port of said first valve to operate said hydraulic motor in a first direction, and said hydraulic motor connected to said first outlet port of said second valve to operate said hydraulic motor in a second direction;

f) a shuttle valve downstream of and connected to said first outlet port of said first valve and said first outlet port of said second valve, said shuttle valve configured to sense said first pressure and said second pressure; and g) a flow restriction positioned downstream of said first outlet port of said first valve and said first outlet port of said second valve.

2. The hydraulic circuit of claim 1, wherein said hydraulic pump further comprises a variable displacement hydraulic pump, said variable displacement hydraulic pump configured to vary said flow of hydraulic fluid to said hydraulic circuit, said variable displacement hydraulic pump including a controller responsive to a pressure.

3. The hydraulic circuit of claim 2, wherein the shuttle valve is configured to permit hydraulic fluid associated with the higher of said first pressure and said second pressure to flow to said controller, thereby providing the higher pressure to which said controller responds and adjusts said variable displacement hydraulic pump.

4. The hydraulic circuit of claim 1, wherein at least one of said first valve and said second valve is a solenoid actuated valve.

5. The hydraulic circuit of claim 1, wherein at least one of said first valve and said second valve is a solenoid actuated valve configured to provide a response in proportion to a magnitude of an actuation signals received by said solenoid actuated valve, thereby providing a variable decrease in the at least one of said first pressure and said second pressure.

6. The hydraulic circuit of claim 1, further comprising a pressure accumulation device positioned downstream of said first outlet port of said first valve and said first outlet port of said second valve and before said hydraulic pump.

7. The hydraulic circuit of claim 1, wherein the flow restriction is positioned before said hydraulic pump.

8. The hydraulic circuit of claim 1, wherein the flow restriction is positioned before said tank.

9. A hydraulic circuit for use on a construction machine, said hydraulic circuit comprising:

a) at least one tank configured for providing hydraulic fluid to and receiving hydraulic fluid from said hydraulic circuit;

b) at least one hydraulic pump connected to said at least one tank, said hydraulic pump providing a flow of hydraulic fluid to said hydraulic circuit at an initial pressure;

c) a first valve that includes:

i. at least one inlet port connected to said hydraulic pump;

ii. a first outlet port over which said first valve is configured to reduce said initial pressure to a first pressure downstream of said first outlet port of said first valve;

iii. at least a second outlet port connected to said tank, said second outlet port configured to return excess hydraulic fluid to said tank;

d) at least a second valve that is in a parallel relationship to said first valve, said second valve including:

i. at least one inlet port connected to said hydraulic pump;

ii. a first outlet port over which said second valve is configured to reduce said initial pressure to a second pressure downstream of said first outlet port of said second valve;

iii. at least a second outlet port connected to said tank, said second outlet port configured to return excess hydraulic fluid to said tank; and, e) a hydraulic motor connected to said first outlet port of said first valve to operate said hydraulic motor in a first direction, and said hydraulic motor connected to said first outlet port of said second valve to operate said hydraulic motor in a second direction wherein at least one of said first valve and said second valve is a solenoid actuated valve.

10. The hydraulic circuit of claim 9, wherein at least one of said first valve and said second valve is configured to provide a response in proportion to a magnitude of an actuation signals received by said solenoid actuated valve, thereby providing a variable decrease in the at least one of said second pressure and said third pressure.

11. The hydraulic circuit of claim 9, further comprising a third valve in parallel with said first valve and said second valve, said third valve configured to maintain a pressure in said hydraulic circuit upstream of said first valve and said second valve below a threshold pressure, said third valve including:

a) at least one inlet port connected to said hydraulic pump;

b) at least one outlet port connected to said tank, said outlet port configured to return an excess of hydraulic fluid to said tank from said outlet port.

12. The hydraulic circuit of claim 11, wherein said third valve includes a spring that applies a spring force to adjust said third valve so that when said pressure is less than or equal to said threshold pressure said flow is prevented from exiting said outlet port.

13. The hydraulic circuit of claim 12, wherein said third valve includes a pilot valve that senses said pressure upstream of said inlet port, and wherein said pilot valve operates in combination with said spring to adjust said third valve.

14. The hydraulic circuit of claim 11, wherein said first outlet port of said first valve and said first outlet port of said second valve are connected to said third valve.

15. The hydraulic circuit of claim 11, further comprising a shuttle valve downstream of and connected to said first outlet port of said first valve and said first outlet port of said second valve, said shuttle valve configured to sense said first pressure and said second pressure and to permit hydraulic fluid associated with the higher of said first pressure and said second pressure to flow to said third valve, thereby providing a resultant force to said third valve that is additive with said spring force.

16. The hydraulic circuit of claim 11, further comprising a pressure accumulation device positioned downstream of said first outlet port of said first valve and said first outlet port of said second valve and before said third valve.

17. The hydraulic circuit of claim 11, further comprising at least one flow restriction positioned downstream of said first outlet port of said first valve and said first outlet port of said second valve and before at least one of said third valve and said tank.

18. The hydraulic circuit of claim 9, wherein at least one of said first valve and said second valve is configured to receive and to provide a response in proportion to a magnitude of an actuation signal$_t$, thereby providing a variable decrease in the at least one of said first pressure and said second pressure, said hydraulic circuit further comprising:

a) at least one power source that includes an output sensor to detect an output of said power source and to generate a output signal reflective of said output; and, b) a control system that includes i. an input device that generates an input signal reflective of a position of said input device as an operator manipulates said input device;

ii. a memory storage device configured to store an operating program, said operating program configured to calculate said actuation signal$_t$ as a function of at least one of said input signal; said output signal; an actuation signal$_{t-1}$, said actuation signal$_{t-1}$ being stored in said memory storage device; a first database that correlates said input signal relative to time; a second database that correlates said actuation signal$_{t-1}$ to said input signal; a first gain that allows an operator to selectively increase and decrease said magnitude of said actuation signal$_t$ relative to said input signal; a second gain that selectively increases and decreases said magnitude of said actuation signal$_t$ relative to said output signal;

c) a controller configured to receive at least one of said input signal from said input device and said output signal from said power source; to run said operating program; and, to transmit said actuation signal$_t$ to at least one of said first valve and said second valve.

19. A lift crane comprising:

a lower portion;

an upper portion that includes a boom mounted thereto;

a swing bearing rotatably coupling said lower portion to said upper portion; and a hydraulic circuit comprising:

at least one tank configured for providing hydraulic fluid to and receiving hydraulic fluid from said hydraulic circuit;

at least one hydraulic pump connected to said at least one tank, said hydraulic pump providing a flow of hydraulic fluid to said hydraulic circuit at an initial pressure;

a first valve that includes:

at least one inlet port connected to said hydraulic pump;

a first outlet port over which said first valve is configured to reduce said initial pressure to a first pressure downstream of said first outlet port of said first valve;

at least a second outlet port connected to said tank, said second outlet port configured to return excess hydraulic fluid to said tank;

at least a second valve that is in a parallel relationship to said first valve, said second valve including:

at least one inlet port connected to said hydraulic pump;

a first outlet port over which said second valve is configured to reduce said initial pressure to a second pressure downstream of said first outlet port of said second valve;

at least a second outlet port connected to said tank, said second outlet port configured to return excess hydraulic fluid to said tank; and, a hydraulic motor connected to said first outlet port of said first valve to operate said hydraulic motor in a first direction, and said hydraulic motor connected to said first outlet port of said second valve to operate said hydraulic motor in a second direction, wherein at least one of said first valve and said second valve is a solenoid actuated valve, and wherein said hydraulic circuit controls a rotation of said upper portion relative to said lower portion.

* * * * *